US007123549B2

(12) United States Patent
Robert et al.

(10) Patent No.: US 7,123,549 B2
(45) Date of Patent: Oct. 17, 2006

(54) WATCH INCLUDING A PRESSURE SENSOR

(75) Inventors: Pascal Robert, Tramelan (CH); Felix Marti, Langendorf (CH)

(73) Assignee: ETA SA Manufacture Horlogér Suisse, Grenchen (CH)

( * ) Notice: Subject to any disclaimer, the term of this patent is extended or adjusted under 35 U.S.C. 154(b) by 0 days.

(21) Appl. No.: 11/300,346

(22) Filed: Dec. 15, 2005

(65) Prior Publication Data

US 2006/0133213 A1 Jun. 22, 2006

(30) Foreign Application Priority Data

Dec. 17, 2004 (EP) ..... 04029987

(51) Int. Cl.
*G04B 47/06* (2006.01)
*G04B 37/00* (2006.01)

(52) U.S. Cl. ..... 368/11; 368/309

(58) Field of Classification Search ..... 368/10, 368/11, 88, 281, 309
See application file for complete search history.

(56) References Cited

U.S. PATENT DOCUMENTS 4,783,772 A 11/1988 Umemoto et al.
5,500,835 A 3/1996 Born
5,592,442 A * 1/1997 Nishikawa et al. ..... 368/11
6,219,304 B1 * 4/2001 Mignot et al. ..... 368/88
6,278,659 B1 * 8/2001 Yokouchi ..... 368/11
6,754,137 B1 * 6/2004 Bourquin et al. ..... 368/11

FOREIGN PATENT DOCUMENTS

| | | |
|---|---|---|
| EP | 0 677 798 A2 | 10/1995 |
| EP | 1 006 418 A1 | 6/2000 |
| EP | 1 544 696 A2 | 6/2005 |
| JP | 05 288626 | 11/1993 |
| JP | 2000-292559 | 10/2000 |

OTHER PUBLICATIONS

European Search report issued in corresponding application No. EP 04 02 9987 completed Jul. 4, 2005.

* cited by examiner

*Primary Examiner*—Vit W. Miska
(74) *Attorney, Agent, or Firm*—Griffin & Szipl, P.C.

(57) ABSTRACT

The invention concerns a device for mounting a pressure sensor simply and precisely on the back cover (11) of a diver's watch or altimeter watch. The pressure sensor (31) is driven into an intermediate ring (33) forming part of a sensor module (30) which further includes an additional PCB (34), a sensor support (35) and connecting elements (38) between the additional PCB (34) and a main PCB of the watch. To ensure very precise positioning relative to the back cover, the intermediate ring (33) includes feet (35) that engage in holes in the additional PCB and in the sensor support. A sealing gasket (32) is radially compressed between the wall of the orifice (12) of the back cover and a tubular casing (47) of the pressure sensor. The back cover (11) is covered externally by a perforated cover.

11 Claims, 4 Drawing Sheets

WATCH INCLUDING A PRESSURE SENSOR

This application claims priority from European Patent Application No. 04029987.7, filed Dec. 17, 2004, the entire disclosure of which is incorporated herein by reference.

BACKGROUND OF THE INVENTION

The present invention concerns a watch of the type comprising a case provided with a back cover that is resistant to ambient pressure, a pressure sensor mounted in an orifice of the back cover with an intermediate ring, and a printed circuit element connected to terminals of the pressure sensor, said sensor comprising a rigid substrate fitted with said terminals, a tubular casing secured to the substrate in a water-resistant manner and arranged to fit into the intermediate ring, and a pressure sensitive element, which is mounted on the substrate and located inside the tubular casing.

In some watches having a pressure sensor mounted on the water-resistant back cover of the watchcase, vertical helical springs are provided for electrically connecting the terminals of the sensor to the main printed circuit of the watch. EP Patent No. 667 798 shows various possible arrangements of the sensor in the back cover of the watchcase, but in every case, the connecting springs are held in place by means of an insulating support plate which extends between the main printed circuit and the back cover. However, if one wishes to associate the sensor with a printed circuit element that directly processes these output signals, in particular to calibrate pressure measurements by calibrating parameters that are individually determined for each sensor, the construction is more complicated and problems arise in the precise mutual positioning of the electric contacts.

A watch with a pressure sensor of the type indicated hereinbefore appears in the drawings of JP Patent Application No. 2000-292559 A. The pressure sensor is driven into a pot-shaped intermediate element, whose peripheral cylindrical wall is itself driven into the orifice of the back cover of the case from the external side. It seems that this assembly enables rubber sealing gaskets to be omitted. However, the proper orientation of the assembly, in particular of the intermediate element, relative to the back cover is only guaranteed with the aid of visual markers. In fact, there is no need for a high level of positioning precision in this case, since the electrical connection between the sensor and the rest of the electronic circuits of the watch is achieved by means of a flexible printed circuit, welded to the terminals of the sensor. But if this flexible element has to connect the sensor to an additional printed circuit board to process the sensor signals, multiple, successive, sometimes difficult operations are required to mount these components respectively on the back cover and in the case.

SUMMARY OF THE INVENTION

It is an object of the present invention to overcome the drawbacks of the prior art owing to a device for mounting the pressure sensor in the back cover of the watchcase that provides a very high level of precision in positioning the various elements, in particular for guaranteeing the mutual positioning of the electrical contacts before applying them against each other, with a simple and easy method of assembling the parts of the device, then the watch itself. Moreover, the mounting device should allow use of a standard type of pressure sensor, easily available on the market.

Therefore, there is provided a watch of the type indicated hereinbefore, characterized in that it comprises a sensor module including at least the intermediate ring, the pressure sensor, the printed circuit element and a sensor support placed against the printed circuit element on the opposite side of said sensor and arranged to withstand the force resulting from ambient pressure on the sensor, said force being transmitted from said support to the back cover via members for securing the sensor module, in that the sensor module is mounted in a water-resistant manner and centred in the orifice of the back cover and in that the intermediate ring comprises feet arranged to engage without any play in positioning holes for the printed circuit element.

Thus, the intermediate ring ensures very precise positioning of the printed circuit element relative to the sensor, enabling electrical connections to be used simply by contact and without any welding between the contact pads of the element and the sensor terminals, which facilitates the assembly of the sensor module. Further, this ring ensures very precise positioning of the printed circuit element and the sensor module assembly relative to the back cover of the case, and thus relative to the rest of the case and to the main printed circuit board, to which the module has to be electrically connected, for example by means of connection elements such as springs housed in the sensor support. Precise centring of the sensor module in the back cover orifice can be achieved either on the intermediate ring in the orifice, or on the tubular casing of the sensor, which is itself driven into said ring. These arrangements also facilitate the assembly of the watch, by establishing electrical contacts between the sensor module and the other circuits in an extremely simple manner, particular by avoiding the use of a flexible printed circuit. The fact that the output members of the sensor module are positioned as directly as possible in relation to the watchcase breaks the usual chain of tolerances that accumulate in conventional mounting devices.

In a preferred embodiment of the invention, the tubular casing of the sensor is prominent relative to a frontal face of the intermediate ring, in the direction of the external side of the back cover, and an annular sealing gasket makes the mounting of the sensor module in the back cover water-resistant, for example an O-ring joint, which is radially compressed between said tubular casing and a wall of the back cover orifice, said annular sealing gasket being capable of abutting axially against the frontal face of the intermediate ring. In other words, this ring is located behind the annular sealing gasket, such that the external pressure and humidity cannot reach the contact surfaces between the back cover and the intermediate ring, or those between the intermediate ring and the sensor. Moreover, the sealing gasket is small and the operation of assembling the sensor module with the back cover is easy, as will be explained hereinafter.

BRIEF DESCRIPTION OF THE DRAWINGS

Other features and advantages of the present invention will appear more clearly from the following description, which presents an advantageous embodiment by way of non-limiting example with reference to the annexed drawings, in which.

DETAILED DESCRIPTION OF ONE EMBODIMENT

Figure 1:
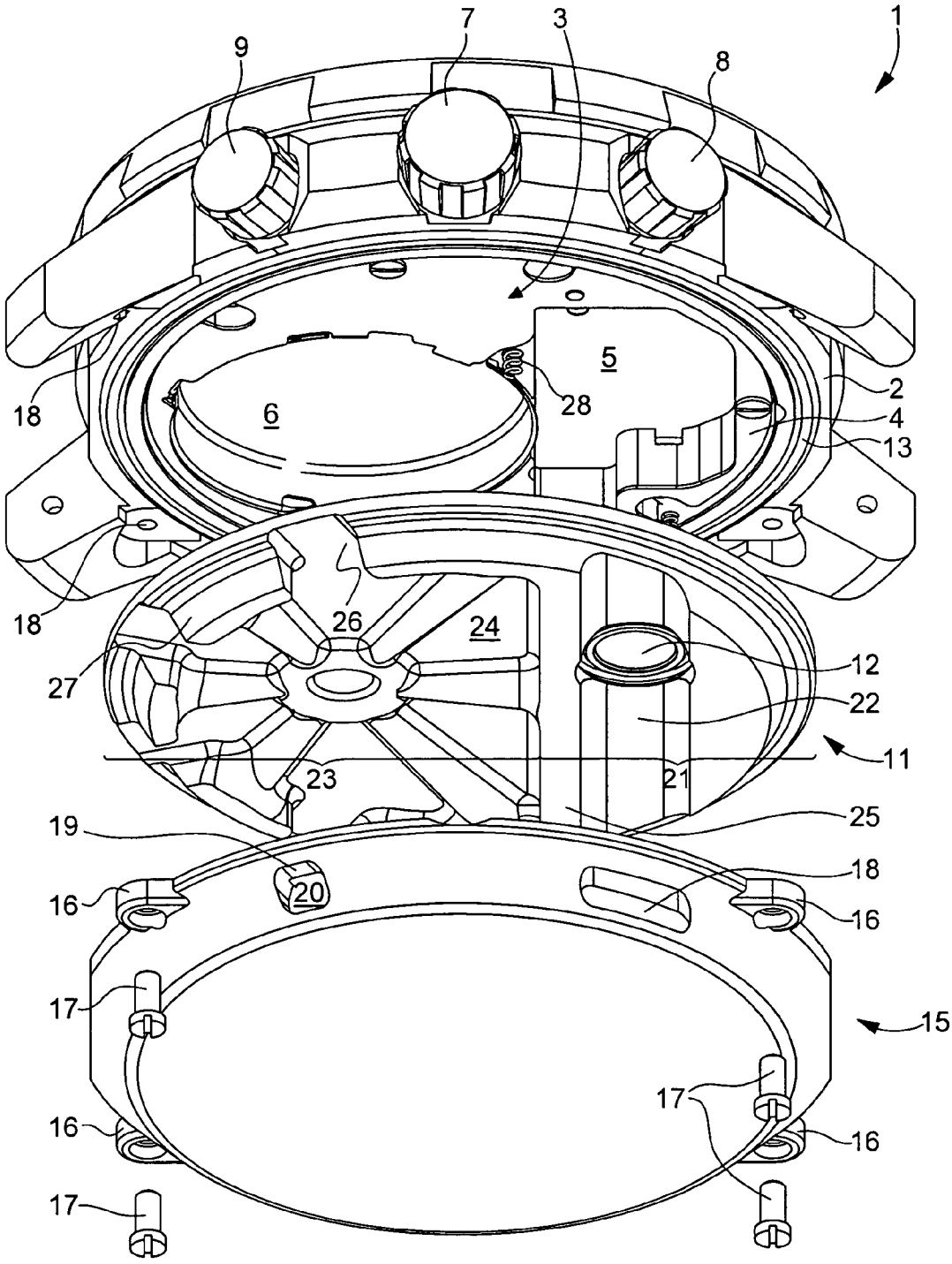
FIG. 1 is an exploded bottom view of a diver's watch according to the invention, whose case includes a water-resistant back cover covered with a perforated cover.

The diver's wristwatch 1 shown in an exploded view in FIG. 1 comprises, in a conventional manner, a case whose middle part 2 surrounds the electronic watch movement 3, which is supported by a plate 4 made of an insulating material. FIG. 1 shows that plate 4 includes in particular a housing 5 for a sensor module 30 (FIG. 2) and a housing 6 for an electric battery powering the watch. The sensor module includes a pressure sensor which, in a known manner, supplies output signals which represent in particular the ambient pressure and which are processed by the electronic movement to provide a pressure indication via the watch display means, whose functions are controlled by the user by means of a crown 7 and push-buttons 8 and 9.

The pressure sensor module is mounted in an orifice 12 of a back cover 11 which closes the bottom of the watchcase in a water-resistant manner, by being pressed against an annular sealing gasket 13 housed in a groove of middle part 2. In the present case, back cover 11 is pressed against middle part 2 by an external cover 15 provided with lugs 16 for fixing the cover to middle part 2 by means of screws 17 engaging in threaded holes 18 in the middle part. Between back cover 11 and cover 15 there is a chamber 20 of low height which communicates with the exterior of the watch via apertures 18, 19 arranged in the inclined flanks of cover 15 so as to avoid being blocked by the wrist of the person wearing the watch. Because of these apertures, the ambient pressure prevailing outside the watch also permanently prevails inside chamber 20. In order for the pressure to be able to be transmitted without any obstacles between aperture 18 and orifice 12, which is located in a first relatively thick and high region 21 of back cover 11, a groove 22 is arranged in the external face of region 21 of the back cover and causes orifice 12 to communicate with aperture 18 and another identical aperture located on the other side of the cover.

The second region 23 of back cover 11 includes a more flexible part 24 than the first region, separated from groove 22 by a rigid rib 25. Part 24 receives on its inner face a piezoelectric element to form an acoustic transducer which is powered via a connection spring 28. The acoustic signals that the watch can thus transmit in chamber 20 under cover 15 are transmitted to the exterior by apertures 19, preferably placed facing notches 26 of a peripheral edge 27 of back cover 11.

Figure 3:
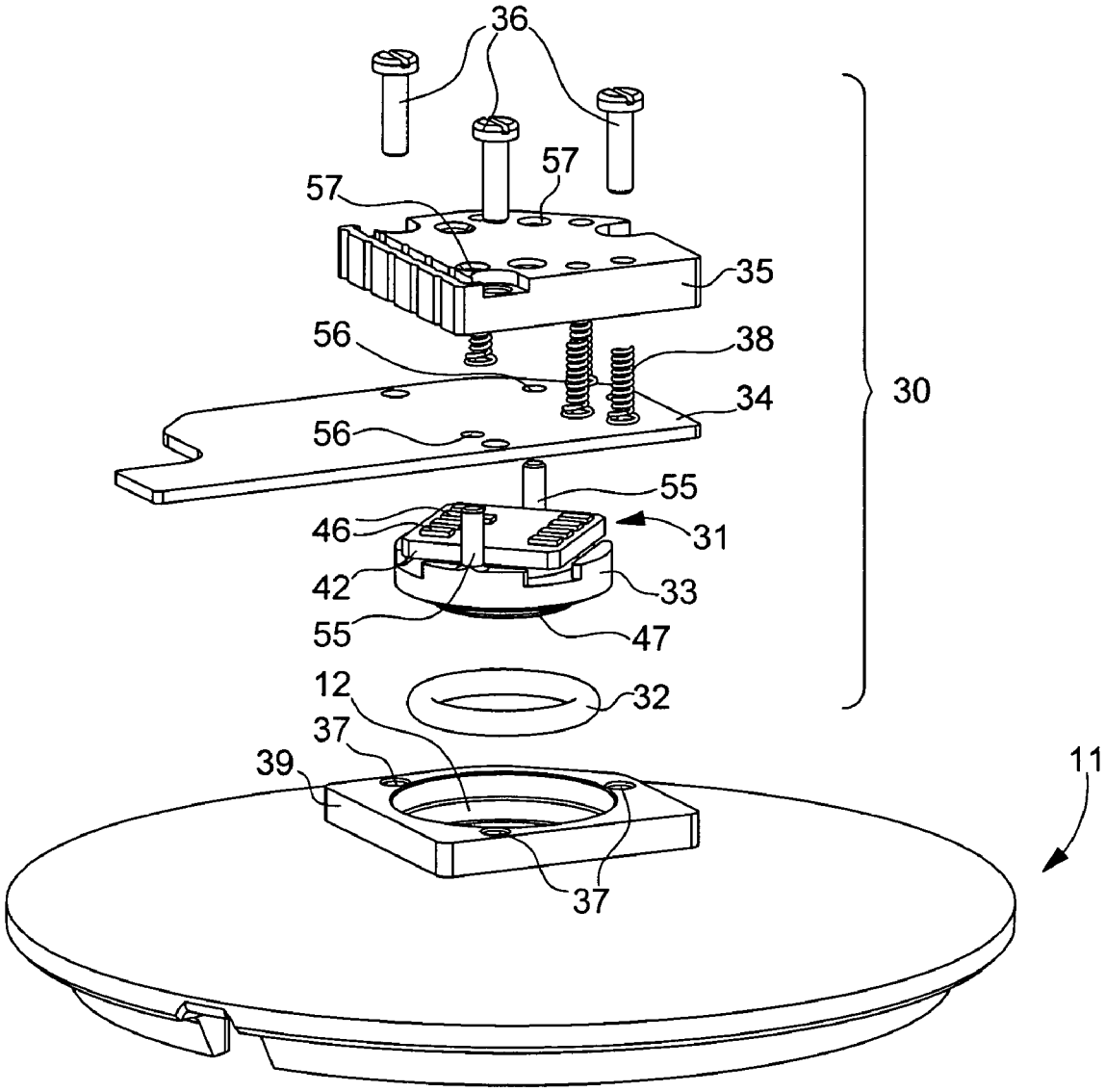
FIG. 3 is an exploded perspective view of the assembly shown in FIG. 2.
Figure 4:
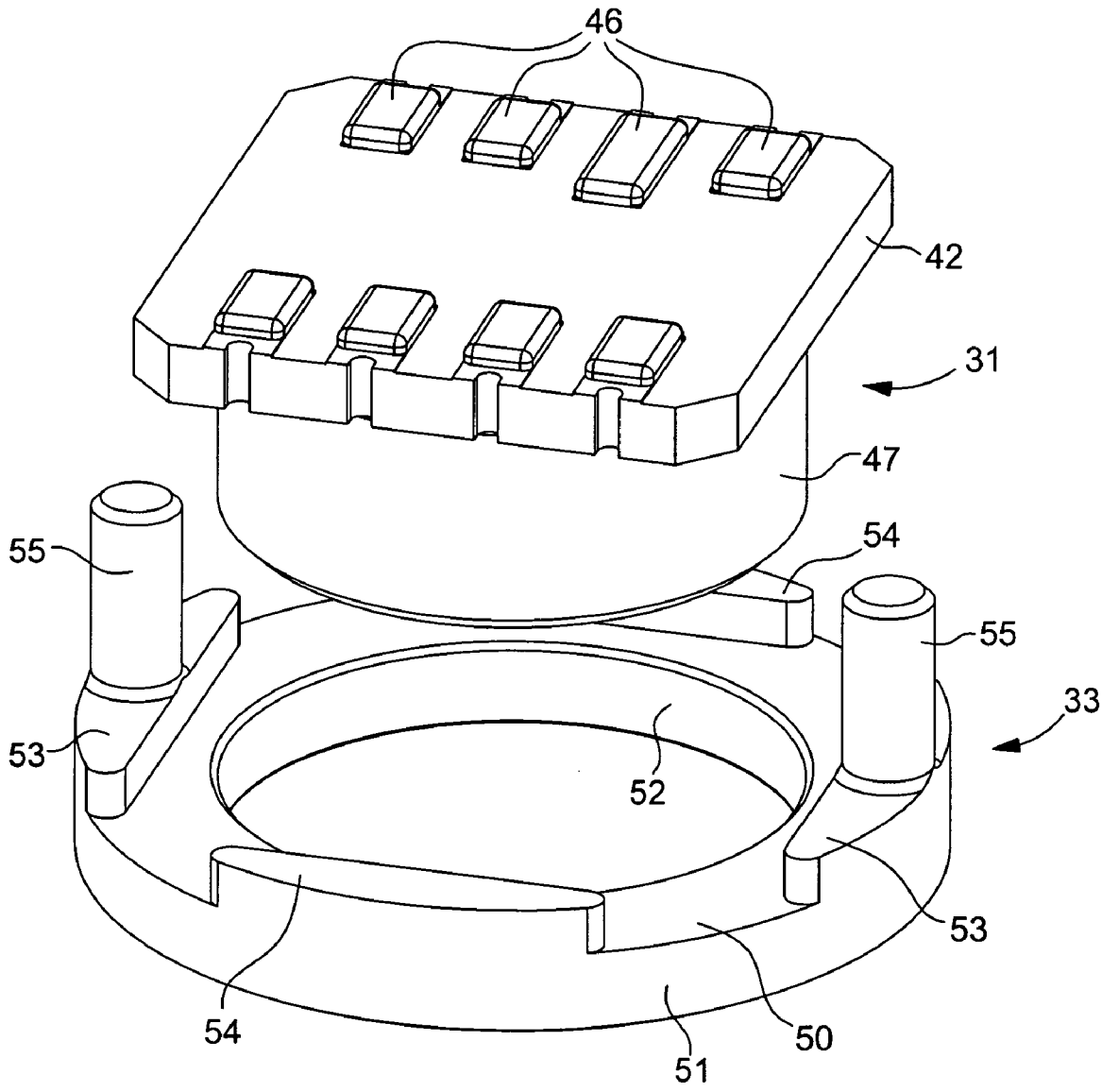
FIG. 4 is an enlarged view of two parts that appear in FIG. 3.

The present invention particularly concerns the arrangement of the sensor module and the way that it is mounted on back cover 11, which will now be described with more particular reference to FIGS. 2 to 4. It will be noted that the cross-section illustrated in FIG. 2 is taken in the longitudinal axis of groove 22 of back cover 11.

Sensor module 30 includes a pressure sensor 31 of a known type, an O-ring sealing joint 32, an intermediate ring 33, an additional printed circuit board (PCB) 34, a sensor support 35 and screws 36 passing through holes in elements 34 and 35 to engage in blind threaded holes 37 of a protruding part 39 of back cover 11 to secure the sensor module therein. Other holes pass through support 35, helical springs 38 being housed in said holes, to provide electrical connections between additional PCB 34 and the main printed circuit board (PCB) of the watch, which is placed on the top face of plate 4 shown in FIG. 1. It will be noted that it is possible to use elastomeric stratified connectors, known by the name of zebras, instead of springs 58.

Figure 2:
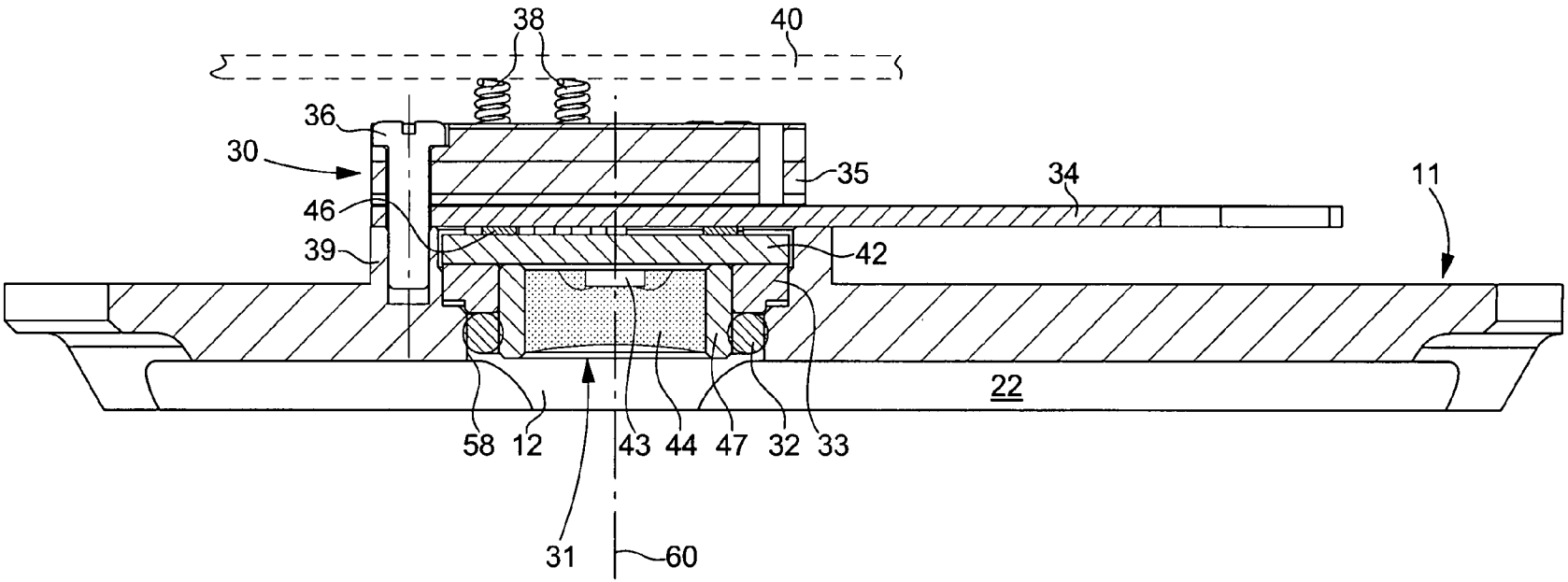
FIG. 2 is a cross-section of the back cover and a pressure sensor module mounted on the back cover.

As can be seen in more detail in FIG. 2, pressure sensor 31 includes a rectangular insulating substrate 42, for example made of ceramic material, provided with printed circuits and on the bottom face of which there is a pressure sensitive semi-conductor element 43, coated in a protective gel 44 which transmits the ambient pressure thereto. The other face of substrate 42 is fitted with electric terminals 46 electrically connected to sensitive element 43 and to be applied against contact pads of additional PCB 34. Around sensitive element 43, the pressure sensor includes a rigid tubular casing 47 whose back end is secured in a water-resistant manner to substrate 42, to form a type of pot that contains gel 44. This type of pressure sensor is well known and supplied on the market by various manufacturers.

Intermediate ring 33 is preferably a synthetic moulded part. It includes an annular part 50 whose external 52 and internal walls 52 are cylindrical, two pairs of protruding parts 53 and 54 having plane inner faces which define a rectangular housing for orienting substrate 42 of sensor 31, and two parallel cylindrical feet 55 located outside said rectangular housing, in this case on protruding parts 53, and extending parallel to the central axis of the ring towards the inside of the watch. The two feet 55 are arranged to fit without any play in two holes 56 of additional PCB 34 in order to position the latter precisely in its own plane, in particular relative to terminals 46 of sensor 31. Further, feet 55 emerge beyond PCB 34 and also fit into holes 57 of sensor support 35, thus positioning springs 38 precisely opposite PCB 34 and also facing the exterior of sensor module 30.

Sensor 31 is driven into intermediate ring 33, its tubular casing 47 abutting against inner surface 52 of the ring to ensure that one part is perfectly centred in relation to the other. However, the positioning of substrate 42 can take advantage of quite large tolerances, since terminals 46 do not need a very high level of positioning precision in relation to PCB 34.

Tubular casing 47 of the sensor is prominent towards the bottom in relation to the lower frontal face of ring 33, as can be seen in particular in FIG. 2, which allows O-ring joint 32 to be fitted around casing 47. Thus, the pre-assembled sensor module 30 can be mounted on back cover 11 of the watch by inserting elements 32 and 33 in orifice 12 of the back cover. Joint 32, compressed between tubular casing 47 and a cylindrical wall 58 of orifice 12, provides a water-resistant seal between the sensor and the back cover and can abut axially against the lower face of intermediate ring 33. In the embodiment described here, this ring 33 can have a slight lateral play in relation to back cover 11, sensor module 33 being centred in orifice 12 by O-ring joint 32, but in other embodiments, it is intermediate ring 33 which could centre the module in orifice 12 via its external cylindrical surface 51. The set of elements of sensor module 30 is oriented about central axis 60 of orifice 12 by screws 36 engaging in threaded holes 37 and by feet 55 of the intermediate ring. Sensor module 30 and protruding part 39 of back cover 11 occupy housing 5 shown in FIG. 1.

When the ambient pressure is high, particularly during a deep dive, the force that it exerts on sensor 31 in orifice 12 is transmitted through substrate 42, terminals 46 and additional PCB 34 as far as support 35, which is sufficiently rigid to prevent deformations of the aforecited elements and to transmit the force to back cover 11 via screws 36.

The preceding description shows that the invention enables the elements of sensor module 30 to be assembled simply on back cover 11 in a water-resistant and very precise manner, such that when the back cover is set in place on the watchcase, the connecting elements 38 of the sensor module will have the precise position required to be applied against the corresponding contacts of the watch circuits, supported by plate 3 of the watch.

The invention can be applied to any watch including a pressure sensor, particular a diver's watch or altimeter watch.

What is claimed is:

1. A watch including a case provided with a back cover resistant to ambient pressure, a pressure sensor mounted in an orifice of the back cover with an intermediate ring, and a printed circuit element connected to the terminals of the pressure sensor, said sensor including a rigid substrate provided with said terminals, a tubular casing secured to the substrate in a water-resistant manner and arranged to fit into the intermediate ring, and a pressure-sensitive element, which is mounted on the substrate and located inside the tubular casing, said watch including a sensor module including at least the intermediate ring, the pressure sensor, the printed circuit element and a sensor support placed against the printed circuit element on the opposite side to said sensor and arranged to withstand the force resulting from the ambient pressure on the sensor, said force being transmitted from said support to the back cover by members for securing the sensor module, wherein the sensor module is mounted in a water-resistant manner and centred in the orifice of the back cover and wherein the intermediate ring includes feet arranged to engage in positioning holes of the printed circuit element without any play.

2. The watch according to claim 1, wherein said feet are further engaged in holes in the sensor support.

3. The watch according to claim 1, wherein said feet are cylindrical.

4. The watch according to claim 1, wherein the tubular casing of the sensor is prominent in relation to a frontal face of the intermediate ring, towards the exterior side of the back cover, and wherein said sensor module is mounted in the back cover in a water-resistant manner by an annular sealing gasket, which is compressed radially between said tubular casing and a wall of the orifice of the back cover, said annular sealing gasket being capable of abutting axially against said frontal face.

5. The watch according to claim 4, wherein the sensor module is centred in said orifice by the annular sealing gasket.

6. The watch according to claim 4, wherein the sensor module is centred in said orifice by driving the intermediate ring into the orifice.

7. The watch according to claim 1, wherein the watchcase includes a middle part, to which the back cover is connected in a water-resistant manner, and a cover covering the back cover externally so as to arrange a chamber between the back cover and the cover in which ambient pressure is transmitted through at least one aperture in the cover.

8. The watch according to claim 7, wherein the cover is secured to the middle part and forces the back cover to abut in a water-resistant manner against the middle part.

9. The watch according to claim 7, wherein the back cover is secured to the middle part in a water-resistant manner and wherein the cover is secured to the back cover.

10. The watch according to claim 7, wherein the back cover includes a first region, in which said orifice and a groove are located on the side of said chamber and which connects said orifice to said aperture in the cover, and a second region having a more flexible part than the first region, said part and said groove being separated by a rigid rib.

11. The watch according to claim 10, wherein a piezoelectric element is secured to said more flexible part to form an acoustic transducer.

* * * * *